US009446605B2

(12) United States Patent
Sasaki

(10) Patent No.: US 9,446,605 B2
(45) Date of Patent: Sep. 20, 2016

(54) RECORDING APPARATUS

(71) Applicant: SEIKO EPSON CORPORATION, Tokyo (JP)

(72) Inventor: Tsuneyuki Sasaki, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/444,903

(22) Filed: Jul. 28, 2014

(65) Prior Publication Data

US 2015/0029280 A1 Jan. 29, 2015

(30) Foreign Application Priority Data

Jul. 29, 2013 (JP) ..... 2013-156421

(51) Int. Cl.
*B41J 2/01* (2006.01)
*B41J 11/00* (2006.01)

(52) U.S. Cl.
CPC ..... *B41J 11/0015* (2013.01); *B41J 11/002* (2013.01)

(58) Field of Classification Search
CPC ..... B41M 7/0072–7/009; B41J 11/0015; B41J 11/002
USPC ..... 347/102
See application file for complete search history.

(56) References Cited

U.S. PATENT DOCUMENTS 3,849,905 A * 11/1974 Bierworth ..... G03G 15/2007 34/242
4,217,093 A * 8/1980 Steinlehner et al. ..... 432/59
4,355,225 A * 10/1982 Marsh ..... 219/216
4,452,524 A * 6/1984 Parisi ..... G03G 15/6529 399/122
4,674,734 A * 6/1987 Ibuchi ..... B65H 3/02 271/117
5,081,502 A * 1/1992 Mitsuya ..... G03G 15/201 399/336
5,712,672 A 1/1998 Gooray et al.
6,092,891 A * 7/2000 Okubo et al. ..... 347/104
6,406,141 B2 * 6/2002 Yosimura et al. ..... 347/102
6,428,158 B1 * 8/2002 Szlucha ..... 347/102
8,292,419 B2 * 10/2012 Hori ..... 347/102

(Continued)

FOREIGN PATENT DOCUMENTS

EP 2 781 361 9/2014
JP 2000 075773 3/2000

(Continued)

OTHER PUBLICATIONS

PPS Data sheet downloaded from http://www.bearingworks.com/content_files/pdf/retainers/PPS%20datasheet.pdf on Jul. 1, 2015.*

(Continued)

*Primary Examiner* — Jannelle M Lebron
*Assistant Examiner* — Jeremy Bishop
(74) *Attorney, Agent, or Firm* — Workman Nydegger

(57) ABSTRACT

A recording apparatus includes an electromagnetic wave irradiating portion that radiates an electromagnetic wave and dries ink by using the electromagnetic wave; a first medium supporting portion that supports a recording medium in an irradiation area of the electromagnetic wave irradiating portion and has an opening portion through which vapor evaporated from ink ejected onto the recording medium by electromagnetic wave irradiation by the electromagnetic wave irradiating portion passes; and a second medium supporting portion that is provided adjacent to the first medium supporting portion and has a thermal conductivity lower than the first medium supporting portion.

10 Claims, 5 Drawing Sheets

(56) References Cited

U.S. PATENT DOCUMENTS

| | | | | |
|---|---|---|---|---|
| 2005/0151815 | A1 | 7/2005 | Kanai et al. | |
| 2014/0285601 | A1* | 9/2014 | Sasaki et al. | 347/102 |

FOREIGN PATENT DOCUMENTS

| | | | | |
|---|---|---|---|---|
| JP | 2000075773 | A * | 3/2000 | G03G 21/20 |
| JP | 2009-073023 | | 4/2009 | |
| JP | 2009-233858 | | 10/2009 | |
| JP | 04429923 | | 12/2009 | |
| JP | 2012-045855 | | 3/2012 | |
| JP | 2012-232532 | | 11/2012 | |
| JP | 2013-028094 | | 2/2013 | |
| WO | 2012-153694 | | 11/2012 | |

OTHER PUBLICATIONS

European Search Report for Application No. 14178822.4 dated Dec. 23, 2014.

* cited by examiner

RECORDING APPARATUS

BACKGROUND

1. Technical Field

The present invention relates to a recording apparatus.

2. Related Art

In the related art, recording apparatuses each including a heater that dries ink ejected onto a recording medium are used. Among them, recording apparatuses each including an electromagnetic wave irradiating portion that irradiates a recording medium with an electromagnetic wave are generally used in order to dry ink ejected onto the recording medium. For example, a recording apparatus including an electromagnetic wave irradiation heater such as a halogen heater or a sheath heater is disclosed in JP-A-2013-28094 and JP-A-2012-45855.

In addition, a recording apparatus including a platen that supports a recording medium in a recording medium transportation path and a heater that corresponds to a position of the platen is disclosed in JP-A-2013-28094 and JP-A-2012-45855. Here, a recording medium that is provided adjacent to a plurality of platens made of aluminum alloy in a recording medium transportation direction is disclosed in JP-A-2013-28094.

However, as disclosed in JP-A-2013-28094 and JP-A-2012-45855, in a recording apparatus including a heater of a type irradiating an electromagnetic wave such as infrared light according to the related art, vapor evaporated from ink ejected onto a recording medium is condensed in a medium supporting portion by the heater in some cases so that a recording medium becomes wet.

SUMMARY

An advantage of some aspects of the invention is to suppress the vapor evaporated from the ink by electromagnetic wave irradiation from being condensed in the medium supporting portion.

According to an aspect of the invention, there is provided a recording apparatus including an electromagnetic wave irradiating portion that radiates an electromagnetic wave and dries ink by using the electromagnetic wave; a first medium supporting portion that supports a recording medium in an irradiation area of the electromagnetic wave irradiating portion and has an opening portion through which vapor evaporated from ink ejected onto the recording medium by electromagnetic wave irradiation by the electromagnetic wave irradiating portion passes; and a second medium supporting portion that is provided adjacent to the first medium supporting portion and has a thermal conductivity lower than the first medium supporting portion.

Here, "to support a recording medium in an irradiation area of the electromagnetic wave irradiating portion" for a first medium supporting portion is not limited to a structure in which first medium supporting portion supports the recording medium in the same range as a range of the irradiation area. That is, even if the first medium supporting portion has a configuration of supporting the recording medium in an area (non-irradiation area) outside the range of the irradiation area, as long as the range for supporting the recording medium in the non-irradiation area is in the range for causing temperature to become high due to the heat transfer from the irradiation area, and accordingly condensation is not generated, the range is included in the invention.

Since a result changes according to conditions such as a form or a material of the first medium supporting portion, and an intensity of the energy of the electromagnetic wave irradiation, the range may not be determined in a uniform manner, but the inventors of the invention confirmed that condensation does not generally occur up to a point in the range of about 20 mm beyond than the irradiation area.

Further, the structure of supporting the recording medium in a range narrower than the irradiation area is also included in the scope of the invention. In the case of the structure of supporting the recording medium in a narrower range, the lower limit is not limited to a specific range in relation to the problem of condensation.

In addition, the "opening portion" in the "opening portion through which vapor evaporates from ink passes" of the first medium supporting portion means an opening through which the evaporated vapor passes toward an opposite side of the first medium supporting portion from the recording medium.

In this case, an opening portion through which vapor evaporated from ink passes is provided in the first medium supporting portion. Therefore, it is possible to cause the vapor evaporated from the ink by electromagnetic wave irradiation to escape through the opening portion in a direction going away from a part of the first medium supporting portion that faces the recording medium, that is, a contact area of the first medium supporting portion and the recording medium. According to this, it is possible to easily reduce an actual amount of the vapor which becomes the condensation source in the vicinity of the medium supporting portion, and thus hardly any condensation occurs in the vicinity of the medium supporting portion.

Then, in this case, the second medium supporting portion that has a thermal conductivity lower than the first medium supporting portion is provided adjacent to the first medium supporting portion. Therefore, hardly any condensation occurs due to the second medium supporting portion having a lower thermal conductivity in an area outside of the irradiation area (the non-irradiation area) and outside the first medium supporting portion.

That is, in this case, it is possible to suppress the vapor evaporated from the ink by the electromagnetic wave irradiation from condensing in the medium supporting portion by combining the first medium supporting portion (having the opening portion) and the second medium supporting portion (having a lower thermal conductivity than the first medium supporting portion). According to this, it is possible to reduce a possiblilty that the recording medium may become wet and dirty.

The recording apparatus may further include a transporting portion that transports the recording medium, the second medium supporting portion has the first medium supporting portion adjacent to at least one side of the recording medium in a transportation direction by the transporting portion.

In the recording apparatus including the transporting portion that transports the recording medium, it is possible to effectively suppress the condensation of the vapor evaporated from the ink by the electromagnetic wave irradiation in the medium supporting portion.

In the recording apparatus, the second medium supporting portion has a thermal conductivity equal to or greater than 0.057 W/(m·K) and equal to or less than 30 W/(m·K).

In this case, the second medium supporting portion has a thermal conductivity equal to or greater than 0.057 W/(m·K) and equal to or less than 30 W/(m·K). Therefore, for example, a thermal conductivity is lower than a medium supporting portion made of, for example, an aluminum alloy having a thermal conductivity of about 230 W/(m·K) in the related art and hardly any vapor is condensed on the surface of the corresponding second medium supporting portion. That is, it is possible to suppress the vapor evaporated from the ink by the electromagnetic wave irradiation from being condensed in the second medium supporting portion. As described above, since the first medium supporting portion can cause the vapor to escape by being provided with the opening portion, the amount of the vapor which becomes the condensation source can be decreased so that the vapor can be further suppressed from being condensed on the surfaces of the corresponding second medium supporting portion.

In the recording apparatus, a supporting area of the recording medium on which the first medium supporting portion supports the recording medium is smaller than a supporting area of the recording medium on which the second medium supporting portion supports the recording medium.

In this case, the size of a supporting surface of the recording medium on which the first medium supporting portion supports the recording medium is smaller than the size of a supporting surface of the recording medium on which the second medium supporting portion supports the recording medium. According to the configuration described above, when the recording medium that the vapor penetrates is used, since the vapor density in the vicinity of the first medium supporting portion can be easily decreased, the vapor is easily guided from recording medium supporting surface of the second medium supporting portion to a recording medium supporting surface of the first medium supporting portion. Therefore, it is possible to effectively suppress the vapor evaporated from the ink by the electromagnetic wave irradiation from being condensed in the medium supporting portion.

In the recording apparatus, a contact angle of the second medium supporting portion with a droplet generated by condensation of the vapor evaporated from the ink ejected onto the recording medium by the electromagnetic wave irradiation by the electromagnetic wave irradiating portion is greater than a contact angle in the first medium supporting portion with the droplet.

In this case, the contact angle of the second medium supporting portion with the droplet generated by condensation of the vapor evaporated from the ink ejected onto the recording medium by the electromagnetic wave irradiation by the electromagnetic wave irradiating portion is greater than the contact angle in the first medium supporting portion with the droplet. Having a great contact angle with the droplet means repelling (becoming wet with a droplet being difficult) the droplet being easy, and condensation of a droplet being difficult. That is, it is possible to suppress the vapor evaporated from the ink by the electromagnetic wave irradiation from being condensed in the corresponding medium supporting portion.

The recording apparatus may further include a vapor condensation portion that condenses the vapor that passes through the opening portion.

Here, the "vapor condensation portion" means a configuration that causes vapor in contact with the surface to be more easily condensed than in the medium supporting portion in a drying process. Particularly, the vapor condensation portion is made of a material having a high thermal conductivity such as an aluminum alloy, and is also configured to have a low temperature at which vapor being in contact is condensed. Further, it is obvious that the invention is not limited to the exemplary configuration.

In this case, the first medium supporting portion is provided with the opening portion through which the vapor evaporated from the ink passes, and includes the vapor condensation portion that causes the vapor that passes through the opening portion to be condensed. Therefore, the vapor evaporated from the ink reaches the vapor condensation portion through the opening portion and is actively condensed in the vapor condensation portion.

According to this, it is possible to cause the vapor to be condensed in the vapor condensation portion before the vapor evaporated from the ink is condensed in the second medium supporting portion. That is, it is possible to more effectively suppress the vapor evaporated from the ink by the electromagnetic wave irradiation from being condensed in the second medium supporting portion.

In this case, a thermal conductivity of the vapor condensation portion is higher than a thermal conductivity of the second medium supporting portion.

In this case, a thermal conductivity of the vapor condensation portion is higher than the thermal conductivity of the second medium supporting portion. That is, the vapor condensation portion is configured with a material that causes the condensation more easily than the second medium supporting portion. The vapor evaporated from the ink by the electromagnetic wave irradiation is actively condensed in the vapor condensation portion, and accordingly it is possible to effectively suppress the vapor from being condensed in the second medium supporting portion.

The recording apparatus may further include a transporting portion that transports the recording medium, an electromagnetic wave irradiation length of the electromagnetic wave irradiating portion in an intersecting direction that intersects a transportation direction of the recording medium by the transporting portion corresponds to a length of the first medium supporting portion in the intersecting direction.

Here, the "length of the first medium supporting portion in the intersecting direction" may be a length of an area including an outer frame when the first medium supporting portion includes the outer frame or the like, or may be a length of an area in which the opening portion is provided without including the outer frame.

In addition, "to correspond to a length of the first medium supporting portion in the intersecting direction" means being equal to or greater than the length of the first medium supporting portion in the intersecting direction, and the equal means being slightly smaller than the length of the first medium supporting portion in the intersecting direction.

In this case, the electromagnetic wave irradiation length of the electromagnetic wave irradiating portion in the intersecting direction corresponds to the length of the first medium supporting portion in the intersecting direction. Therefore, the temperature distribution of the first medium supporting portion in the intersecting direction can be made to be small, that is, a portion in which the temperature difference is great is not generated, and accordingly the generation of the condensation at the end portion of the first medium supporting portion in the intersecting direction or the like can be suppressed.

In the recording apparatus, a distance from an electromagnetic wave irradiation area of the electromagnetic wave irradiating portion to the second medium supporting portion is equal to or less than 20 mm.

Here, the "distance from the irradiation area to the second medium supporting portion" is a so-called gap between the irradiation area and the second medium supporting portion, and means a minimum distance from the irradiation area to the second medium supporting portion.

In this case, the distance from an electromagnetic wave irradiation area of the electromagnetic wave irradiating portion to the second medium supporting portion is equal to or less than 20 mm. According to the configuration described above, when the second medium supporting portion made of a material that causes hardly any condensation to occur in an area in which the condensation easily occurs is provided, it is possible to effectively suppress the condensation of the vapor evaporated from the ink by the electromagnetic wave irradiation in the medium supporting portion.

According to another aspect of the invention, there is provided the recording apparatus including a first medium supporting portion that supports a recording medium and has a ventilative opening portion in an electromagnetic wave irradiation area for drying ink; and a second medium supporting portion that is provided adjacent to the first medium supporting portion, the first medium supporting portion and the second medium supporting portion are configured so that condensation of vapor evaporated from the ink recorded on the recording medium by electromagnetic wave irradiation is reduced.

Here, "to be configured so that condensation is reduced" does not mean that vapor is not at all condensed in the medium supporting portion, and the expression is used as meaning that even if condensed liquid in the medium supporting portion is attached to the recording medium, the condensation is not a problem as long as the condensation is not of the degree of being recognized as a stain.

In this case, the first medium supporting portion and the second medium supporting portion are configured so that condensation of vapor evaporated from the ink recorded on the recording medium by electromagnetic wave irradiation by the electromagnetic wave irradiating portion is reduced. Therefore, it is possible to suppress the vapor evaporated from the ink by the electromagnetic wave irradiation from being condensed in the first medium supporting portion and the second medium supporting portion to contaminate the recording medium.

BRIEF DESCRIPTION OF THE DRAWINGS

The invention will be described with reference to the accompanying drawings, wherein like numbers reference like elements.

DESCRIPTION OF EXEMPLARY EMBODIMENTS

Embodiment 1 FIGS. 1 to 4

Hereinafter, a recording apparatus according to Embodiment 1 is described in detail with reference to the accompanying drawings.

First, a recording apparatus according to the embodiment is described. The recording apparatus is a recording apparatus that can perform recording on a recording medium by water-based color ink, but the recording apparatus is not limited to the recording apparatus that can use water color ink. In addition, the recording apparatus is a so-called after heater-type recording apparatus that includes a first medium supporting portion and a second medium supporting portion of the invention at positions different from a recording area (position to which nozzle surface of the recording head can face). However, the invention is not limited to such a recording apparatus, and the recording apparatus may include the first medium supporting portion and the second medium supporting portion of the invention in the recording area. Further, the recording apparatus is a recording apparatus that transmits a recording medium to a recording head and performs recording. However, the recording apparatus may be a so-called flat bed-type recording apparatus that moves a recording head to a medium supporting portion.

Figure 1:
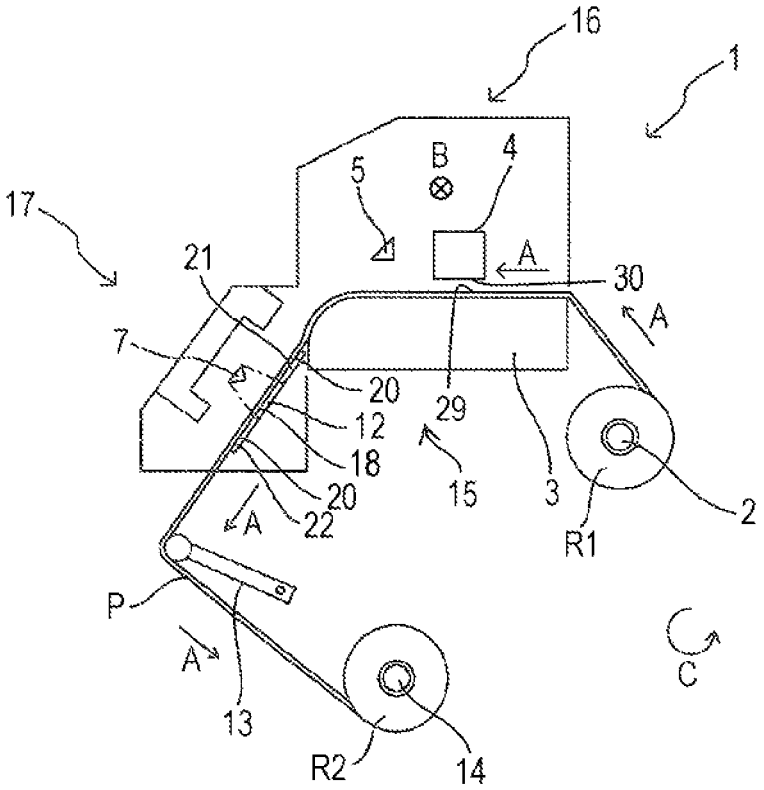
FIG. 1 is a side view schematically illustrating a recording apparatus according to Embodiment 1 of the invention.

FIG. 1 is a side view schematically illustrating a recording apparatus 1 according to the embodiment.

The recording apparatus 1 according to the embodiment includes a setting portion 2 that sets a roller R1 so that a recording medium P on which recording is to be performed can be forwarded. Further, the recording apparatus 1 according to the embodiment uses a roll-type recording medium as the recording medium P, but the recording apparatus 1 is not limited to the recording apparatus that uses such a roll-type recording medium. For example, the recording apparatus 1 may use a single sheet-type recording medium.

In the recording apparatus 1 according to the embodiment, when the recording medium P is transported in a transportation direction A, the setting portion 2 rotates in a rotating direction C.

In addition, the recording apparatus 1 according to the embodiment includes a transporting portion 15 that includes a plurality of transport rollers (not illustrated) for transporting the roll-type recording medium P in the transportation direction A at a position near a platen 3 or the like. The setting portion 2 rotates in the rotating direction C, the plurality of transportation rollers (not illustrated) of the transporting portion 15 rotate, and a winding portion 14 to be described below rotates in the rotating direction C, so that the recording medium P is transported in the transportation direction A. The movement path of the recording medium P at the time of transportation is the transportation path of the recording medium P.

In addition, the recording apparatus 1 according to the embodiment includes a recording mechanism 16 that performs recording by causing a recording head 4 to perform scanning in a reciprocating manner in a scanning direction B that intersects the transportation direction A of the recording medium P. The recording head 4 performs recording by ejecting ink from nozzles onto the recording medium P on a recording area 29 in the transportation path of the recording medium P transported by the transporting portion 15. An image is formed (recorded) on the recording medium P by the ink ejected from the recording head 4. Further, the recording apparatus 1 according to the embodiment includes the recording mechanism 16 that performs recording by causing the recording head 4 to move in a reciprocating manner. However, the recording apparatus may include a so-called line head.

Here, the "line head" is a recording head in which a nozzle area formed in a direction intersecting the transportation direction A of the recording medium P can cover the entire area of the recording medium P in the intersecting direction and which is used in a recording apparatus that forms an image by fixing one of the recording head and the recording medium and moving the other. Further, the nozzle area of the line head in the intersecting direction may not be capable of covering the entire area of the recording medium P in the intersecting direction which corresponds to the recording apparatus.

In addition, here, the area that faces the recording head 4 when recording is performed on the recording medium P is the recording area 29. Specifically, the area that is on a nozzle formed surface 30 of the recording head 4 and faces the nozzle configuration area (not illustrated) that ejects ink is the recording area 29. Further, in the recording mechanism 16, since a portion of a volatile component in the ink ejected onto the recording medium P on the recording area 29 evaporates, an electromagnetic wave irradiation-type platen heater 5 that irradiates the recording area 29 with an electromagnetic wave such as infrared light or the like that can heat the recording area 29 in the range of about 50° C. to 60° C. is provided.

It is desirable to use infrared light as the electromagnetic wave, and the wavelength thereof may range from 0.76 μm to 1000 μm. Generally, infrared light may be further divided into near infrared light, mid infrared light, and far infrared light, according to wavelength. Though there are various definitions of the division, the wavelengths approximately range from 0.78 μm to 2.5 μm, 2.5 μm to 4.0 μm, and 4.0 μm to 1000 μm. From this infrared light, it is preferable to use the mid-infrared light.

A drying mechanism 17 is provided on the downstream side of the recording medium P of the recording head 4 in the transportation direction A. The drying mechanism 17 includes the electromagnetic wave irradiation portion 7 that can irradiate the recording medium P on which recording is performed by the recording head 4, with an electromagnetic wave such as infrared light. In addition, the drying mechanism 17 includes a first medium supporting portion 12 that supports the recording medium P in an irradiation area 18 irradiated with the electromagnetic wave from an electromagnetic wave irradiation portion 7, and has an opening portion 19 (see FIG. 2) through which the vapor evaporated from the ink ejected onto the recording medium P by being heated to the range of about 100° C. to 120° C. by the electromagnetic wave irradiation of the electromagnetic wave irradiation portion 7 passes. In the irradiation area 18, the ejected ink is heated to the range of about 100° C. to 120° C. by the electromagnetic wave irradiation of the electromagnetic wave irradiation portion 7. In addition, the drying mechanism 17 includes second medium supporting portions 21 and 22 which are provided adjacent to the first medium supporting portion 12 and of which the thermal conductivity is lower than that of the first medium supporting portion 12. In a recording apparatus in the related art, since a medium supporting portion is manufactured by using a material with high thermal conductivity, the thermal difference between the irradiation area and the non-irradiation area becomes great, and vapor evaporated from ink is condensed in the medium supporting portion in some cases. However, the heat may not escape and the temperature does not easily fall to the low temperature by providing the second medium supporting portion 21 with the lower thermal conductivity than that of the first medium supporting portion 12. That is, the vapor evaporated from the ink does not easily condense on the first medium supporting portion 12 and the second medium supporting portion 21.

Here, in the recording apparatus 1 according to the embodiment, the second medium supporting portion 21 is provided adjacent to the first medium supporting portion 12 on the upstream of the first medium supporting portion 12 in the transportation direction A. Further, the second medium supporting portion 22 is provided adjacent to the first medium supporting portion 12 on the downstream side of the first medium supporting portion 12 in the transportation direction A. However, the invention is not limited to the configuration described above: the second medium supporting portion may be configured to be adjacent to at least one side of the first medium supporting portion 12 in the transportation direction A of the recording medium P transported by the transporting portion 15. That is, either of the second medium supporting portions 21 and 22 may be provided.

In addition, a tension adjusting portion 13 that adjusts the tension of the recording medium P when the recording medium P is wound is provided on the downstream side of the drying mechanism 17 in the transportation direction A of the recording medium P. Then, the winding portion 14 that can wind the recording medium P is provided on the downstream side of the tension adjusting portion 13 in the transportation direction A of the recording medium P. Further, in the recording apparatus 1 according to the embodiment, when a roller R2 of the recording medium P is formed, the winding portion 14 rotates in the rotating direction C.

Subsequently, the first medium supporting portion 12 will be described in detail.

Figure 2:
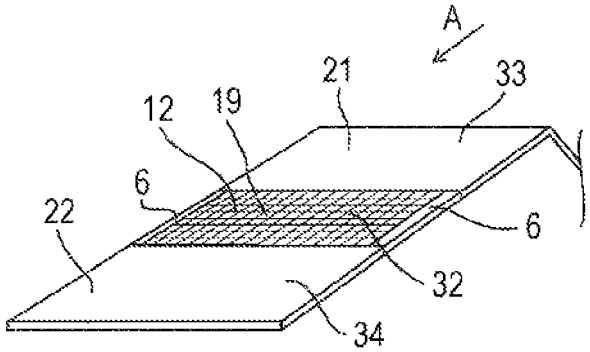
FIG. 2 is a perspective view schematically illustrating a first medium supporting portion and second medium supporting portions in the recording apparatus according to Embodiment 1 of the invention.

FIG. 2 is a perspective view schematically illustrating the first medium supporting portion 12 and the second medium supporting portions 21 and 22 in the recording apparatus 1 according to the embodiment.

The opening portion 19 is provided in the first medium supporting portion 12. That is, the opening portion 19 through which vapor evaporated from ink ejected onto the recording medium P can pass toward the opposite side of the recording medium P to the corresponding first medium supporting portion 12 is provided. The opening portion 19 functions to pass the vapor evaporated from the ink, from one surface of the corresponding first medium supporting portion 12 to the other surface.

It is possible to cause the vapor evaporated from the ink by the electromagnetic wave irradiation to escape in a direction of moving away from a portion that faces the recording medium P of the first medium supporting portion 12 through the opening portion 19, that is, a contact area of the first medium supporting portion 12 and the recording medium P, by providing the opening portion 19. According to this, it is possible to easily decrease the actual amount in the vicinity of the corresponding medium supporting portion of the corresponding vapor which is the condensation source, and accordingly the vicinity of the corresponding medium supporting portion is brought into a state in which hardly any condensation occurs. In addition, an outer frame 6 which also functions as a stiffening member is provided in the first medium supporting portion 12.

The shape of the opening portion 19 is not particularly limited, and may be a round shape or a polygonal shape in addition to all structures through which vapor can pass.

As a preferable configuration example of the opening portion 19, a rectangle of which at least a portion is configured by lining up linear members having diameters of 0.3 mm or less in a lattice shape is included. At least a predetermined size of an area is needed for the vapor to be condensed. However, since it is possible to decrease the sizes of areas other than the opening portion by configuring at least a portion of the opening portions by using linear members having diameters of 0.3 mm or less, such a predetermined size of the area can be decreased, and the condensation of the vapor at the contact portion of the recording medium P in the first medium supporting portion 12 can be suppressed to a high degree.

In addition, the opening ratio of the opening portion 19 to the first medium supporting portion 12 is preferably 40% or more. The condensation of the vapor in the first medium supporting portion 12 can be suppressed to a high degree.

According to the embodiment, the second medium supporting portions 21 and 22 having the thermal conductivity lower than the first medium supporting portion 12 neighboring the first medium supporting portion 12 are provided. The second medium supporting portion 21 is provided adjacent to the first medium supporting portion 12 on the upper stream side of the first medium supporting portion 12 in the transportation direction A. In addition, the second medium supporting portion 22 is provided adjacent to the first medium supporting portion 12 on the downstream side of the first medium supporting portion 12 in the transportation direction A.

In this manner, since it is configured so that the first medium supporting portion 12 is provided adjacent to the second medium supporting portions 21 and 22 having the thermal conductivity lower than the first medium supporting portion 12, hardly any condensation occurs in an area outside (the non-irradiation area) the irradiation area 18 and outside the first medium supporting portion 12 due to the second medium supporting portions 21 and 22 having the low thermal conductivity.

Accordingly, the combination of the second medium supporting portions 21 and 22 and the first medium supporting portion 12 having the opening portion 19 can suppress the vapor evaporated from the ink by the electromagnetic wave irradiation from being condensed in the corresponding medium supporting portion.

Further, the recording apparatus 1 according to the embodiment is a recording apparatus including the transporting portion 15 of the recording medium P, but may be configured to provide the second medium supporting portions 21 and 22 to be adjacent to both sides of the first medium supporting portion 12 in the transportation direction A. Therefore, the recording apparatus including the transporting portion 15 of the recording medium P has a configuration capable of effectively suppressing the vapor evaporated from the ink by the electromagnetic wave irradiation from being condensed in the corresponding medium supporting portion. However, in order to achieve the effect described above, the second medium supporting portions 21 and 22 may be provided adjacent to at least one side of the first medium supporting portion 12 in the transportation direction A, and the second medium supporting portions 21 and 22 are not limited to the configuration of being adjacent to both sides of the first medium supporting portion 12 in the transportation direction A.

The second medium supporting portions 21 and 22 according to the embodiment have the thermal conductivity in the range of equal to or greater than 0.057 W/(m·K) and equal to or less than 30 W/(m·K). That is, since the thermal conductivity is low in this manner, hardly any condensation occurs in an area outside (the non-irradiation area) the irradiation area 18 and outside the first medium supporting portion 12 due to the second medium supporting portions 21 and 22 having a low thermal conductivity.

The second medium supporting portions 21 and 22 according to the embodiment have incomparably a lower thermal conductivity than a medium supporting portion made of, for example, aluminum alloy having a thermal conductivity of about 230 W/(m·K) in the related art and are in a state in which hardly any vapor is condensed on the surfaces of the corresponding second medium supporting portions 21 and 22. According to this, it is possible to suppress the vapor evaporated from the ink by the electromagnetic wave irradiation from being condensed in the second medium supporting portions 21 and 22.

As described above, since the first medium supporting portion 12 can cause the vapor to escape by being provided with the opening portion 19, the amount of the vapor which becomes the condensation source can be decreased so that the vapor can be further suppressed from being condensed on the surfaces of the corresponding second medium supporting portions 21 and 22.

Further, the thermal conductivity of the first medium supporting portion 12 is preferably equal to or less than 2.2 W/(m·K), more preferably equal to or less than 0.7 W/(m·K), and particularly preferably equal to or less than 0.3 W/(m·K).

The configuration material of the second medium supporting portions 21 and 22 to cause the thermal conductivity to be in a range of equal to or greater than 0.057 W/(m·K) and equal to or less than 30 W/(m·K) includes, for example, stainless steel. In addition, examples of the configuration material of the second medium supporting portions 21 and 22 to cause the thermal conductivity to be in a range of equal to or greater than 0.057 W/(m·K) and equal to or less than 2.2 W/(m·K) include glass wool, urethane rubber, a vinyl chloride compound, polyether ether ketone (PEEK), polyphenylene sulfide (PPS), bakelite, and silica glass. In addition, a stiffening member such as a glass fiber and a carbon fiber may be included in the materials. Further, among them, plastic materials are preferably used in view of easy processibility.

Figure 3:
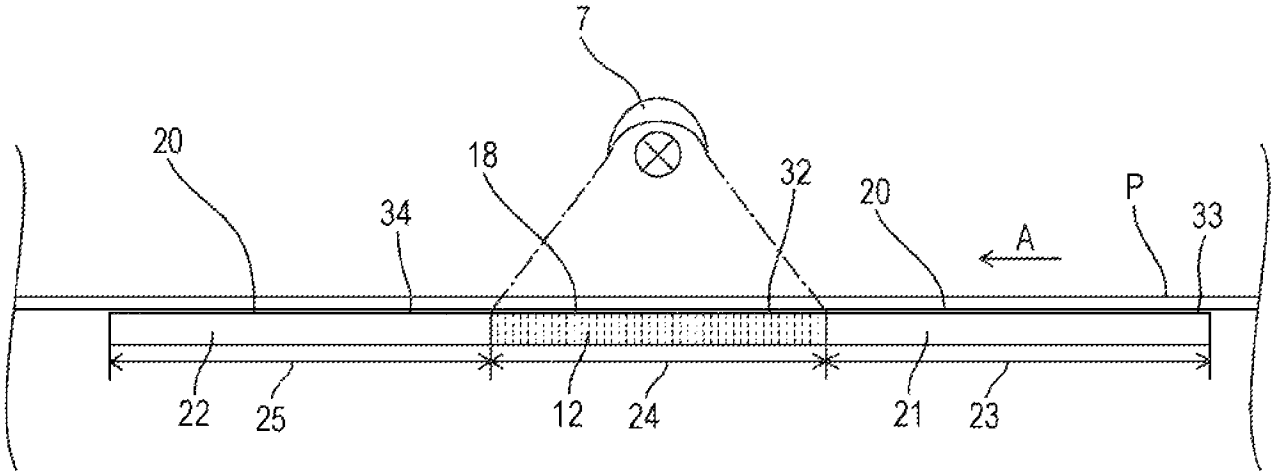
FIG. 3 is a side view schematically illustrating the first medium supporting portion and the second medium supporting portions in the recording apparatus according to Embodiment 1 of the invention.
Figure 4:
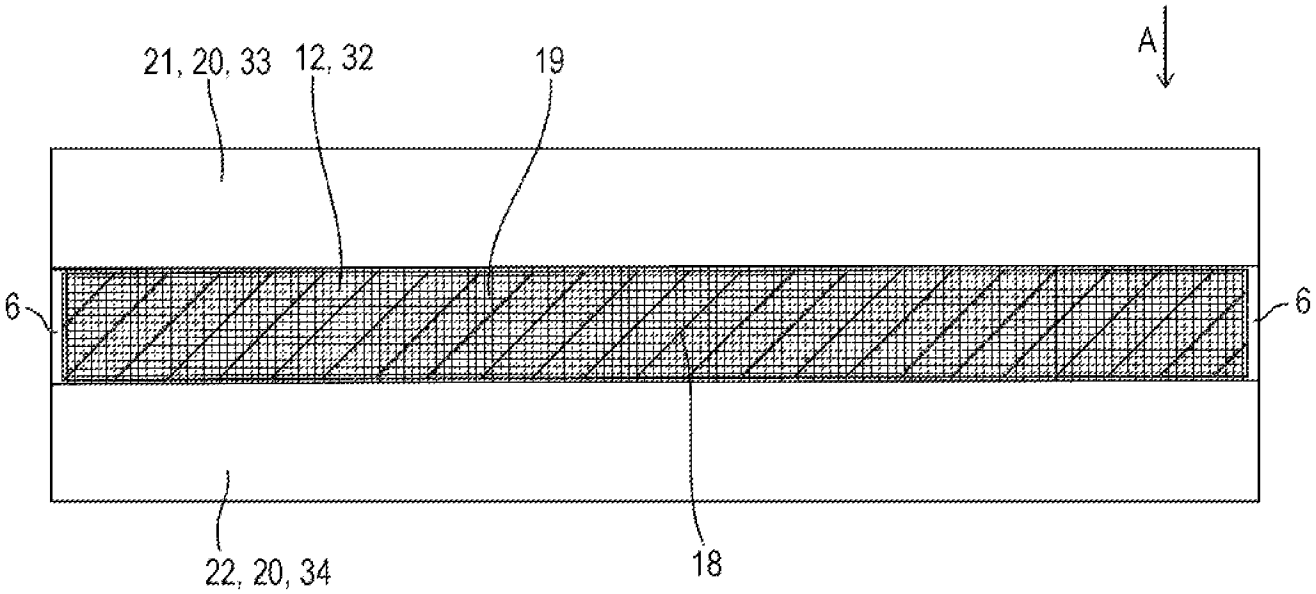
FIG. 4 is a plan view schematically illustrating the first medium supporting portion and the second medium supporting portions in the recording apparatus according to Embodiment 1 of the invention.

FIG. 3 is a side view schematically illustrating the first medium supporting portion 12 and the second medium supporting portions 21 and 22 in the recording apparatus 1 according to the embodiment. In addition, FIG. 4 is a plan view schematically illustrating the first medium supporting portion 12 and the second medium supporting portions 21 and 22 in the recording apparatus 1 according to the embodiment.

Further, the first medium supporting portion 12 and the second medium supporting portions 21 and 22 are provided to be inclined as illustrated in FIGS. 1 and 2 when viewed from the side surface of the recording apparatus 1, but FIG. 3 is a diagram in which the first medium supporting portion 12 and the second medium supporting portions 21 and 22 are horizontally illustrated for an easier description.

In the recording apparatus 1 according to the embodiment, the size of the supporting surface of the recording medium P on which the first medium supporting portion 12 supports the recording medium P is smaller than the size of the supporting surface of the recording medium P on which the second medium supporting portions 21 and 22 support the recording medium P. In detail, as illustrated in FIG. 4, the length of the first medium supporting portion 12 in an intersecting direction that intersects the transportation direction A is identical to the lengths of the second medium supporting portions 21 and 22 in the intersecting direction that intersects the transportation direction A. Meanwhile, as illustrated in FIG. 3, a length 24 of the first medium supporting portion 12 in the transportation direction A is shorter than lengths 23 and 25 of the second medium supporting portions 21 and 22 in the transportation direction A.

According to the configuration described above, for example, when the recording medium P that the vapor penetrates is used, since the vapor density in the vicinity of the first medium supporting portion 12 can be easily decreased, the vapor is easily guided from recording medium P supporting surfaces 33 and 34 of the second medium supporting portions 21 and 22 to a recording medium P supporting surface 32 of the first medium supporting portion 12 and the vapor evaporated from the ink by the electromagnetic wave irradiation is effectively suppressed from being condensed in the medium supporting portion.

Further, in the recording apparatus 1 according to the embodiment, the size of the recording medium P supporting surface 32 of the first medium supporting portion 12 is smaller than the sizes of the recording medium P supporting surfaces 33 and 34 of the second medium supporting portions 21 and 22. However, if the size of the recording medium P supporting surface 32 of the first medium supporting portion 12 is smaller than the size of one of the recording medium P supporting surfaces 33 and 34 of the second medium supporting portions 21 and 22, the vapor can be easily guided from the one of the recording medium P supporting surfaces 33 and 34 to the recording medium P supporting surface 32 of the first medium supporting portion 12. Therefore, the size of the recording medium P supporting surface 32 of the first medium supporting portion 12 may be configured to be smaller than one of the recording medium P supporting surfaces 33 and 34 of the second medium supporting portions 21 and 22.

Further, the invention includes the configuration in which the size of the recording medium P supporting surface 32 of the first medium supporting portion 12 is greater than the size of any one of the recording medium P supporting surfaces 33 and 34 of the second medium supporting portions 21 and 22, though the effect of guiding the vapor is reduced in such a configuration.

In the recording apparatus 1 according to the embodiment, the length of the first medium supporting portion 12, and the second medium supporting portions 21 and 22 in the intersecting direction that intersects the transportation direction A corresponds to the maximum width of the recording medium assumed to be used.

Here, "the maximum width of the recording medium assumed to be used" includes, for example, the maximum width of a usable recording medium and a recommended recording medium described in an operation manual of the recording apparatus, or the like.

In addition, "to correspond to the maximum width of the recording medium assumed to be used" means being equal to or greater than the maximum width of the recording medium assumed to be used, and to be equal means including a case of being slightly shorter than the maximum width of the recording medium assumed to be used.

In addition, as illustrated in the electromagnetic wave irradiation area 18 of the electromagnetic wave irradiation portion 7 of FIG. 4, the electromagnetic wave irradiation length of the electromagnetic wave irradiation portion 7 in the intersecting direction that intersects the transportation direction A corresponds to the length of the first medium supporting portion 12 in the intersecting direction.

Here, "the length of the first medium supporting portion 12 in the intersecting direction" may be the length including the outer frame 6 when the first medium supporting portion 12 according to the embodiment has the outer frame 6 or the like, but may be the length of an area in which the opening portion is provided without including the outer frame 6.

In addition, "to correspond to the length of the first medium supporting portion 12 in the intersecting direction" means being equal to or greater than the length of the first medium supporting portion 12 in the intersecting direction, and to be equal means including a case being slightly shorter than the length of the first medium supporting portion 12 in the intersecting direction.

In the recording apparatus 1 according to the embodiment, the electromagnetic wave irradiation length of the electromagnetic wave irradiation portion 7 in the intersecting direction corresponds to the length of the first medium supporting portion 12 in the intersecting direction. Therefore, it is possible to narrow a temperature distribution of the first medium supporting portion 12 in the intersecting direction, that is, it is possible to suppress the generation of the condensation at an end portion of the first medium supporting portion 12 in the intersecting direction while a portion in which a temperature difference is great is not generated.

In addition, as described above, in the recording apparatus 1 according to the embodiment, the electromagnetic wave irradiation length of the electromagnetic wave irradiation portion 7 in the intersecting direction is the maximum width of the recording medium assumed to be used. Therefore, the temperature distribution of the first medium supporting portion 12 in the intersecting direction is small, and accordingly the generation of the condensation at the end portion of the first medium supporting portion 12 in the intersecting direction is suppressed.

In addition, in the recording apparatus 1 according to the embodiment, the irradiation area 18 in the transportation direction A corresponds to the length of the first medium supporting portion 12 in the transportation direction A. That is, in the transportation direction A, the first medium supporting portion 12 corresponds to the irradiation area 18, and the second medium supporting portions 21 and 22 correspond to non-irradiation areas 20.

In this manner, the first medium supporting portion 12 according to the embodiment supports the recording medium P in accordance with the length of the electromagnetic wave irradiation area 18 of the electromagnetic wave irradiation portion 7 in the transportation direction A and the intersecting direction that intersects the transportation direction A. However, the first medium supporting portion 12 is not limited to the structure of supporting the recording medium P in a range equal to the range of the irradiation area 18. That is, even if the recording medium P is supported up to an area (the non-irradiation area 20) outside the range of the irradiation area 18, as long as the range in which the recording medium P is supported in the non-irradiation area 20 is a range in which the temperature becomes high due to the heat transfer from the irradiation area 18, and accordingly the condensation is not generated, it is acceptable.

In addition, the recording apparatus 1 according to the embodiment is configured so that a contact angle of the second medium supporting portions 21 and 22 with a droplet generated by the condensation of the vapor evaporated from the ink ejected onto the recording medium P by the electromagnetic wave irradiation by the electromagnetic wave irradiation portion 7 is greater than a contact angle of the first medium supporting portion 12 with a droplet.

Having a great contact angle with the droplet means repelling the droplet being easy (becoming wet with the droplet being difficult), and condensation of a droplet being difficult. That is, the first medium supporting portion 12 becomes wet more easily than the second medium supporting portions 21 and 22 (vapor is easily condensed), and the first medium supporting portion 12 can cause the vapor to escape since the opening portion 19 is provided. Accordingly, the recording apparatus 1 according to the embodiment can further suppress the vapor evaporated from the ink by the electromagnetic wave irradiation from being condensed in the medium supporting portion by specifying the contact angle.

Figure 5:
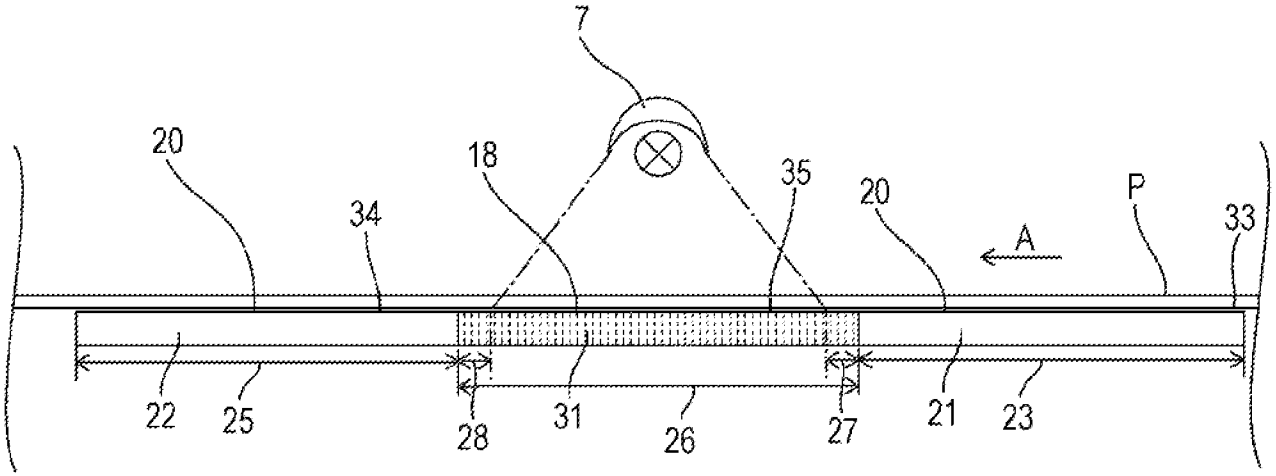
FIG. 5 is a side view schematically illustrating a first medium supporting portion and second medium supporting portions in a recording apparatus according to Embodiment 2 of the invention.

Embodiment 2 FIG. 5

The recording apparatus according to Embodiment 2 is described below in detail with reference to the accompanying drawings.

FIG. 5 is a side view schematically illustrating a first medium supporting portion 31 and the second medium supporting portions 21 and 22 in the recording apparatus 1 according to Embodiment 2.

Here, though the first medium supporting portion 31 and the second medium supporting portions 21 and 22 are provided to be inclined when viewed from the side surface of the recording apparatus 1 in the same manner as in the recording apparatus according to Embodiment 1, FIG. 5 is a diagram horizontally illustrating the first medium supporting portion 31 and the second medium supporting portions 21 and 22 for easier description thereof, in the same manner as FIG. 3.

Further, the recording apparatus in Embodiment 2 is different from the recording apparatus according to Embodiment 1 in that the first medium supporting portion 31 which has a length 26 in the transportation direction A which is slightly longer than the first medium supporting portion 12 is provided in place of the first medium supporting portion 12.

The recording apparatus 1 according to Embodiment 2 includes the first medium supporting portion 31 that has the length 26 in the transportation direction A slightly longer than that of the first medium supporting portion 12 according to Embodiment 1. However, in the same manner as the recording apparatus according to Embodiment 1, the length 26 of the first medium supporting portion 31 in the transportation direction A is shorter than any one of the length 23 of the second medium supporting portion 21 in the transportation direction A and the length 25 of the second medium supporting portion 22 in the transportation direction A. Therefore, the size of a supporting surface 35 of the first medium supporting portion 31 in the recording medium P is smaller than the sizes of recording medium P supporting surfaces 33 and 34 of the second medium supporting portions 21 and 22.

In the recording apparatus 1 according to Embodiment 1, a distance from the electromagnetic wave irradiation area 18 to the second medium supporting portion 21 of the electromagnetic wave irradiation portion 7 and a distance from the irradiation area 18 to the second medium supporting portion 22 are nearly 0 mm. Meanwhile, in the recording apparatus 1 according to Embodiment 2, a distance 27 from the electromagnetic wave irradiation area 18 to the second medium supporting portion 21 of the electromagnetic wave irradiation portion 7 and a distance 28 from the irradiation area 18 to the second medium supporting portion 22 are nearly 20 mm.

According to the configuration described above, when the second medium supporting portions 21 and 22 made of a material that causes hardly any condensation to occur in an area in which the condensation easily occurs are provided, it is possible to effectively suppress the condensation of the vapor evaporated from the ink by the electromagnetic wave irradiation in the medium supporting portion.

Further, "the distance from the irradiation area 18 to the second medium supporting portions 21 and 22" is a so-called gap between the irradiation area 18 and the second medium supporting portions 21 and 22, and means a minimum distance from the irradiation area 18 to the second medium supporting portions 21 and 22.

In addition, in the recording apparatus 1 according to Embodiments 1 and 2, the irradiation area 18 and the second medium supporting portions 21 and 22 are not overlapped with each other, but the irradiation area 18 and the second medium supporting portions 21 and 22 may be configured to be overlapped with each other.

Figure 6:
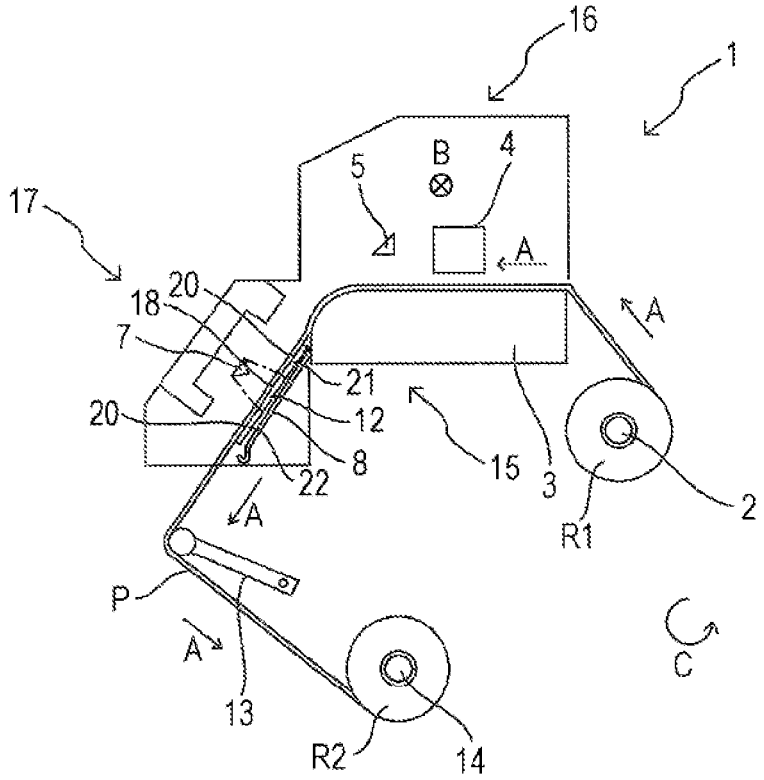
FIG. 6 is a side view schematically illustrating a recording apparatus according to Embodiment 3 of the invention.
Figure 7:
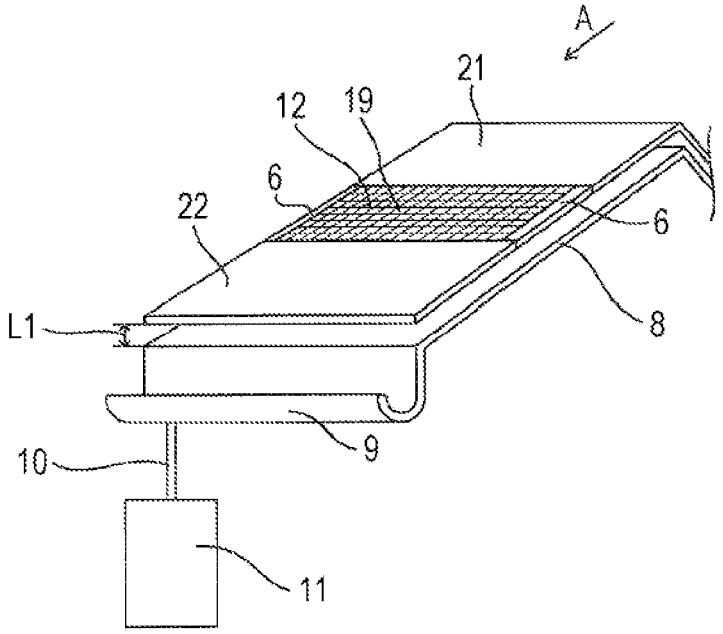
FIG. 7 is a perspective view schematically illustrating the first medium supporting portion, the second medium supporting portions, and a vapor condensation portion in the recording apparatus according to Embodiment 3 of the invention.

Embodiment 3 FIGS. 6 and 7

The recording apparatus according to Embodiment 3 is described in detail with reference to the accompanying drawings.

FIG. 6 is a side view schematically illustrating the recording apparatus 1 according to Embodiment 3. In addition, FIG. 7 is a diagram illustrating the first medium supporting portion 12, the second medium supporting portions 21 and 22, and a vapor condensation portion 8 in the recording apparatus 1 according to Embodiment 3. Further, the elements which are common in Embodiment 1 are denoted by the same reference numerals and descriptions thereof are not provided.

Further, the recording apparatus according to Embodiment 3 is different from the recording apparatus according to Embodiment 1 in that the vapor condensation portion 8 is provided under the first medium supporting portion 12 and the second medium supporting portions 21 and 22 in the drying mechanism 17.

The drying mechanism 17 according to the embodiment includes the vapor condensation portion 8 which has a thermal conductivity higher than those of the first medium supporting portion 12 and the second medium supporting portions 21 and 22, and in which the vapor that passes through the opening portion 19 is condensed.

Here, the vapor condensation portion 8 means a configuration that causes vapor in contact with the surface to be more easily condensed than in the medium supporting portion in a drying process. Particularly, for example, the vapor condensation portion 8 is made of a material having a high thermal conductivity, such as an aluminum alloy, and is also configured so as to have a low temperature at which the condensation easily occurs.

According to Embodiment 3, the vapor evaporated from the ink reaches the vapor condensation portion 8 through the opening portion 19 and is actively condensed in the vapor condensation portion 8.

According to this, it is possible to cause the vapor to be condensed in the vapor condensation portion 8 before the vapor evaporated from the ink is condensed in the second medium supporting portions 21 and 22. That is, it is possible to more effectively suppress the vapor evaporated from the ink by the electromagnetic wave irradiation from being condensed in the second medium supporting portions 21 and 22.

However, the vapor condensation portion 8 is not limited to the configuration described above. As long as the vapor condensation portion 8 has the thermal conductivity at least higher than that of the second medium supporting portions 21 and 22, it is possible to cause the vapor to be actively condensed in the vapor condensation portion 8, and to effectively suppress the vapor from being condensed in the second medium supporting portions 21 and 22.

In addition, the vapor condensation portion 8 according to the embodiment is an element for causing the vapor that passes through the opening portion 19 to be condensed, and a liquid receiver 9 that receives droplets generated by the condensation of the vapor is provided in the lower portion of the vapor condensation portion 8 as illustrated in FIG. 7. In addition, a waste liquid bottle 11 that collects liquid gathered in the liquid receiver 9 through a tube 10 is provided under the liquid receiver 9.

In addition, a thermometric conductivity in the vapor condensation portion 8 is preferably higher than a thermometric conductivity in the first medium supporting portion 12. Since a thermometric conductivity is obtained by dividing a thermal conductivity by density and a specific heat capacity, if a thermometric conductivity of the vapor condensation portion 8 is higher than a thermometric conductivity of the first medium supporting portion 12, the temperature of the vapor condensation portion 8 more easily becomes a low temperature so that heat can be more easily lost than in the first medium supporting portion 12. Therefore, since a thermometric conductivity of the vapor condensation portion 8 and a thermometric conductivity of the first medium supporting portion 12 have a relationship as described above, the condensation of the vapor in the first medium supporting portion 12 can be suppressed to a high degree in the same manner as in the case where the thermal conductivity of the vapor condensation portion 8 is higher than the thermal conductivity of the first medium supporting portion 12.

In addition, the vapor condensation portion 8 preferably has a smaller contact angle with a droplet generated by the condensation of the vapor than the first medium supporting portion 12. This is because the condensation of the vapor can be suppressed to a high degree in the first medium supporting portion 12, since the vapor condensation portion 8 becomes wet more easily than the first medium supporting portion 12.

In addition, the vapor condensation portion 8 according to the embodiment is disposed so that a gap L1 (FIG. 7) between the first medium supporting portion 12 and the second medium supporting portions 21 and 22 is equal to or greater than 2 mm and equal to or less than 20 mm. Here, if the gap L1 between the first medium supporting portion 12 and the second medium supporting portions 21 and 22 is not fixed, the vapor condensation portion 8 is preferably disposed so that the gap L1 between all portions becomes equal to or greater than 2 mm or equal to or less than 20 mm. It is possible to suppress droplets generated by the condensation in the vapor condensation portion 8 from being attached to the first medium supporting portion 12 and the second medium supporting portions 21 and 22 by setting the gap between the vapor condensation portion 8 and the first medium supporting portion 12 and the second medium supporting portions 21 and 22 to be equal to or greater than 2 mm. This is because it is possible to suppress the vapor from condensing in the first medium supporting portion 12 and the second medium supporting portions 21 and 22 in a high degree by setting the gap between the vapor condensation portion 8 and the first medium supporting portion 12 and the second medium supporting portions 21 and 22 to be equal to or less than 20 mm.

As described above in Embodiments 1 to 3, the recording apparatus according to the embodiments of the invention includes the electromagnetic wave irradiation portion 7 that radiates an electromagnetic wave, and dries ink by using the electromagnetic wave, the first medium supporting portion 12 or 31 that supports the recording medium P in the irradiation area 18 of the electromagnetic wave irradiation portion 7 and has the opening portion 19 through which vapor evaporated from ink ejected onto the recording medium P by the electromagnetic wave irradiation by the electromagnetic wave irradiation portion 7 passes, and the second medium supporting portions 21 and 22 that are provided adjacent to the first medium supporting portion 12 or 31 and have a thermal conductivity lower than the first medium supporting portion 12 or 31.

According to this, since an opening portion through which vapor evaporated from ink passes is provided in the first medium supporting portion 12 or 31, it is possible to cause the vapor evaporated from the ink by electromagnetic wave irradiation to escape through the opening portion 19 in a direction moving away from a part of the first medium supporting portion 12 or 31 that faces the recording medium P, that is, a contact area of the first medium supporting portion 12 or 31 and the recording medium P. According to this, it is possible easily to reduce an actual amount of the vapor which becomes the condensation source in the vicinity of the medium supporting portion, and thus hardly any condensation occurs in the vicinity of the medium supporting portion.

Then, since the second medium supporting portions 21 and 22 having a thermal conductivity lower than the first medium supporting portion 12 or 31 are provided adjacent to the first medium supporting portion 12 or 31, hardly any condensation occurs due to the second medium supporting portions 21 and 22 having a lower thermal conductivity in an area outside of the irradiation area 18 (the non-irradiation area 20) and outside the first medium supporting portion 12 or 31.

Accordingly, it is possible to suppress the vapor evaporated from the ink by the electromagnetic wave irradiation from condensing in the medium supporting portion by combining the first medium supporting portion 12 or 31 having the opening portion 19 and the second medium supporting portions 21 and 22 having a low thermal conductivity as described above.

In addition, in other words, the recording apparatus according to the embodiments of the invention includes the first medium supporting portion 12 or 31 which supports the recording medium P and on which the ventilative opening portion 19 is provided in the electromagnetic wave irradiation area 18 for drying ink, and the second medium supporting portions 21 and 22 which are provided adjacent to the first medium supporting portion 12 or 31, and the first medium supporting portion 12 or 31 and the second medium supporting portions 21 and 22 are configured so that the condensation of the vapor evaporated from the ink recorded on the recording medium P by the electromagnetic wave irradiation is reduced.

Further, "to be configured so that the condensation is reduced" does not mean that vapor is not at all condensed in the medium supporting portion, and the expression is used as meaning that even if condensed liquid in the medium supporting portion is attached to the recording medium, the condensation is not a problem as long as the condensation is of the degree of not being recognized as a stain.

According to the characteristics described above, it is possible to suppress the vapor evaporated from the ink by the electromagnetic wave irradiation from being condensed in the first medium supporting portion 12 or 31 and the second medium supporting portions 21 and 22 to contaminate the recording medium P.

The entire disclosure of Japanese Patent Application of No. 2013-156421, filed Jul. 29, 2013 is expressly incorporated by reference herein.

What is claimed is:

1. A recording apparatus comprising:

an electromagnetic wave irradiating portion that radiates an electromagnetic wave and dries ink by using the electromagnetic wave;

a first medium supporting portion that supports a recording medium in an irradiation area of the electromagnetic wave irradiating portion and has an opening portion through which vapor evaporated from ink ejected onto the recording medium by electromagnetic wave irradiation by the electromagnetic wave irradiating portion passes, wherein the opening portion is formed by linear members arranged in a lattice shape; and a second medium supporting portion that supports the recording medium in an area spaced apart from the irradiation area and that is provided adjacent to the first medium supporting portion and has a thermal conductivity lower than the first medium supporting portion, wherein both the first medium supporting portion and the second medium supporting portion are downstream of a recording area.

2. The recording apparatus according to claim 1, further comprising:

a transporting portion that transports the recording medium, wherein the second medium supporting portion is adjacent to the first medium supporting portion adjacent in a transportation direction and to at least one side of the recording medium in a transportation direction that is transverse to the transportation direction.

3. The recording apparatus according to claim 1, wherein the second medium supporting portion has a thermal conductivity equal to or greater than 0.057 W/(m·K) and equal to or less than 30 W/(m·K).

4. The recording apparatus according to claim 1, wherein a supporting area of the recording medium on which the first medium supporting portion supports the recording medium is smaller than a supporting area of the recording medium on which the second medium supporting portion supports the recording medium.

5. The recording apparatus according to claim 1, wherein a contact angle of the second medium supporting portion with a droplet generated by condensation of the vapor evaporated from the ink ejected onto the recording medium by the electromagnetic wave irradiation by the electromagnetic wave irradiating portion is greater than a contact angle in the first medium supporting portion with the droplet.

6. The recording apparatus according to claim 1, further comprising:

a vapor condensation portion that condenses the vapor that passes through the opening portion.

7. The recording apparatus according to claim 6, wherein a thermal conductivity of the vapor condensation portion is higher than a thermal conductivity of the second medium supporting portion.

8. The recording apparatus according to claim 1, further comprising:

a transporting portion that transports the recording medium, wherein an electromagnetic wave irradiation length of the electromagnetic wave irradiating portion in an intersecting direction that intersects a transportation direction of the recording medium by the transporting portion corresponds to a length of the first medium supporting portion in the intersecting direction.

9. The recording apparatus according to claim 1, wherein a distance from an electromagnetic wave irradiation area of the electromagnetic wave irradiating portion to the second medium supporting portion is equal to or less than 20 mm.

10. A recording apparatus comprising:

a first medium supporting portion that supports a recording medium and has a ventilative opening portion in an electromagnetic wave irradiation area for drying ink, wherein the ventilative portion is formed by linear members arranged in a lattice shape; and a second medium supporting portion that supports the recording medium in an area spaced apart from the irradiation area and that is provided adjacent to the first medium supporting portion in the electromagnetic wave irradiation area, wherein the first medium supporting portion and the second medium supporting portion are configured so that condensation of vapor evaporated from the ink recorded on the recording medium by electromagnetic wave irradiation is decreased, wherein both the first medium supporting portion and the second medium supporting portion are downstream of a recording area.

* * * * *